US005944469A

United States Patent [19]

Theurer et al.

[11] Patent Number: 5,944,469

[45] Date of Patent: Aug. 31, 1999

[54] BOX CAR FOR CARRYING BULK MATERIAL

[75] Inventors: Josef Theurer, Vienna; Friedrich Öllerer, Linz, both of Austria

[73] Assignee: Franz Plasser Bahnbaumaschinen-Industriegesellschaft m.b.H., Vienna, Austria

[21] Appl. No.: 08/955,196

[22] Filed: Oct. 21, 1997

[30] Foreign Application Priority Data

Oct. 22, 1996 [AT] Austria ..... 1854/96

[51] Int. Cl.[6] ..... B65G 67/02

[52] U.S. Cl. ..... 414/339; 414/505; 414/523; 414/528; 213/62 R

[58] Field of Search ..... 414/339, 523, 414/503–505, 528, 340; 213/62 R, 63, 66, 69

[56] References Cited

U.S. PATENT DOCUMENTS

| | | | |
|---|---|---|---|
| 3,863,783 | 2/1975 | Spellman, Jr. | 414/523 |
| 4,576,538 | 3/1986 | Theurer et al. | 414/339 |
| 4,655,916 | 4/1987 | Schlesiger | 414/339 X |
| 4,809,617 | 3/1989 | Theurer et al. | 414/339 X |
| 5,099,766 | 3/1992 | Whitaker, Jr. | 414/339 X |
| 5,151,002 | 9/1992 | Theurer et al. | 414/339 |
| 5,203,662 | 4/1993 | Theurer et al. | 414/339 |
| 5,221,172 | 6/1993 | Theurer et al. | 414/339 |
| 5,277,538 | 1/1994 | Theurer et al. | 414/339 X |
| 5,718,556 | 2/1998 | Forsyth | 414/523 X |

FOREIGN PATENT DOCUMENTS

| | | | |
|---|---|---|---|
| 4104877 | 8/1991 | Germany | 414/528 |
| 2 277 725 | 11/1994 | United Kingdom . | |

*Primary Examiner*—David A. Bucci
*Attorney, Agent, or Firm*—Collard & Roe, PC

[57] ABSTRACT

A box car for carrying bulk material and capable of being incorporated into a freight train of a plurality of successively arranged like box cars, the box car comprising a box having an open top and an endless horizontal conveyor at the bottom, one of the endless conveyor ends being a rear end in the conveying direction and another endless conveyor end being a front end in the conveying direction, and a bulk material transfer device for transferring the bulk material from a preceding to a succeeding box car, the preceding and succeeding box cars being coupled to each other, the bulk material transfer device comprising an inclined endless conveyor having a lower end and an upper end, a drive for moving the inclined endless conveyor, and an adjusting drive for adjusting the distance of the transfer device from the ends of the horizontal endless conveyor, and the inclined endless conveyor being so arranged that the lower end subtends the front end of the horizontal endless conveyor of the preceding box car, and the higher end overlaps the rear end of the horizontal endless conveyor of the succeeding box car.

12 Claims, 3 Drawing Sheets

Fig. 4
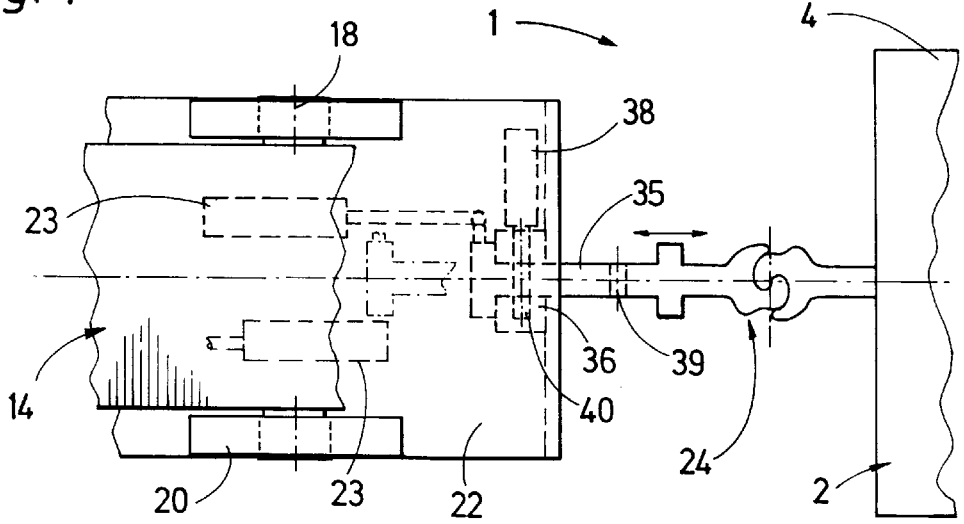
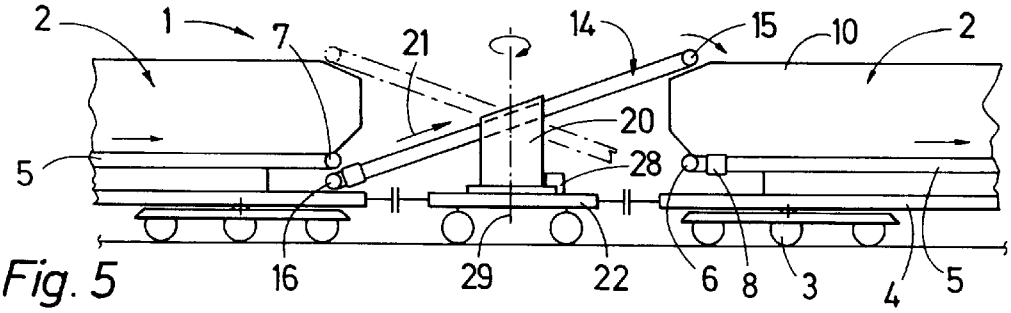
Fig. 5
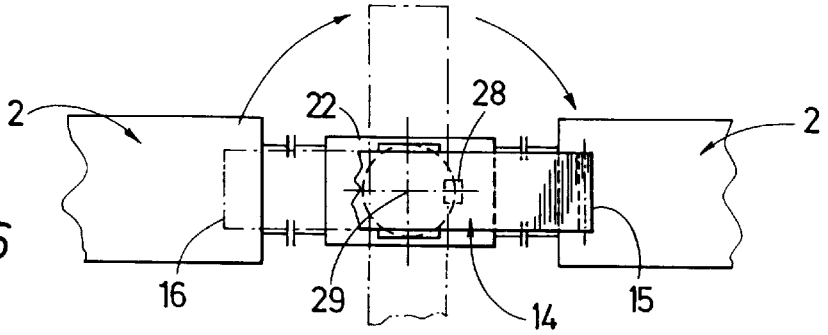
Fig. 6
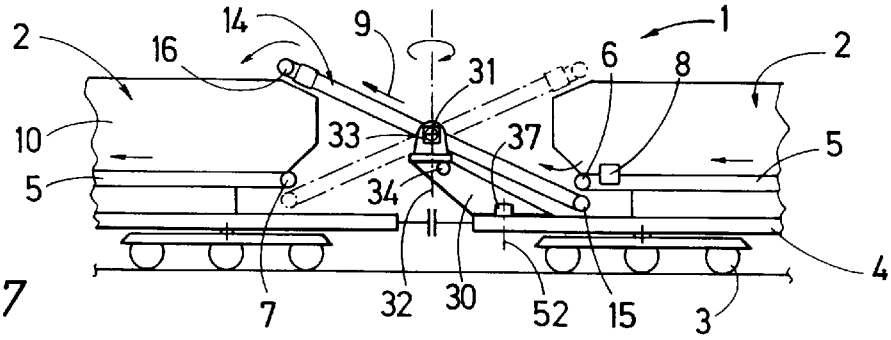
Fig. 7

BOX CAR FOR CARRYING BULK MATERIAL

BACKGROUND OF THE INVENTION

1. Field of the Invention

The present invention relates to a box car for carrying bulk material and capable of being incorporated into a freight train of a plurality of successively arranged like box cars. The box car comprises a chassis, an elongated box for storing the bulk material, the elongated box extending in a longitudinal direction and being mounted on the chassis, and the box having an open top and a bottom region, and a conveyor arrangement extending in the longitudinal direction in the bottom region, the conveyor arrangement comprising a substantially horizontally extending endless conveyor having two ends spaced from each other in the longitudinal direction and a drive for moving the endless conveyor in a conveying direction, one of the endless conveyor ends being a rear end in the conveying direction and another one of the endless conveyor ends being a front end in the conveying direction. A bulk material transfer device is provided for transferring the bulk material from a preceding box car to a succeeding box car, the preceding and succeeding box cars being coupled to each other, the bulk material transfer device comprising an inclined endless conveyor having a lower end and an upper end, and a drive for moving the inclined endless conveyor.

2. Description of the Prior Art

A box car of this type has been disclosed in U.S. Pat. No. 4,576,538. According to the patent, the bulk material transfer device is a conveyor band projecting over the open storage box of the succeeding box car to fill this storage box. The conveyor arrangement in the bottom region of the box car is also a conveyor band, which may be driven at a different speed so that the storage box may be filled when the conveyor band proceeds at a lower speed to push the transferred bulk material heap slowly ahead in the longitudinal direction. On the other hand, when the conveying speed is increased, the bulk material may be moved to the preceding box car without storage. A freight train comprised of a suitable number of such box cars may be advantageously used, for example, to convey ballast and/or detritus excavated by a ballast cleaning machine from a box car at the excavating site at one end of the train to preceding box cars where the ballast and/or detritus is stored.

In the box car of British patent No. 2,277,725, the transfer device subtends one end of the bottom conveyor arrangement and is pivotal about a horizontal axis extending transversely to the longitudinal direction so that the transfer device may be driven from a first, elevated position for transferring the bulk material to an adjoining box car to a second, lowered position for discharging the bulk material directly on a track bed while reducing the height of the fall of the discharged bulk material.

U.S. Pat. No. 5,151,002 discloses still a further embodiment of such a box car, in which two parallel bottom and transfer conveyors are driven in opposite directions. One end of one of the bottom conveyors is subtended by the associated transfer conveyor while the transfer conveyor associated with the other bottom conveyor overlaps an opposite end thereof. A longitudinally extending wall separates the storage box into two halves so that each bottom conveyor has its own storage box. This makes it possible to convey and store bulk material independently in two opposite directions.

SUMMARY OF THE INVENTION

It is the primary object of this invention to provide a box car of the first-described type which enables the bulk material to be conveyed in opposite directions while involving little additional construction costs and a minimum of retrofitting.

This and other objects are accomplished according to the invention with a box car for carrying bulk material and capable of being incorporated into a freight train of a plurality of successively arranged like box cars, wherein the box car comprises a chassis, an elongated box for storing the bulk material, the elongated box extending in a longitudinal direction and being mounted on the chassis, and the box having an open top and a bottom region, and a conveyor arrangement extending in the longitudinal direction in the bottom region. The conveyor arrangement comprises a substantially horizontally extending endless conveyor having two ends spaced from each other in the longitudinal direction and a drive for moving the endless conveyor in a conveying direction, one of the endless conveyor ends being a rear end in the conveying direction and another one of the endless conveyor ends being a front end in the conveying direction. A bulk material transfer device transfers the bulk material from a preceding one of two successive box cars to a succeeding box car, the preceding and succeeding box cars being coupled to each other. The bulk material transfer device comprises an inclined endless conveyor having a lower end and an upper end, a drive for moving the inclined endless conveyor, and an adjusting drive for adjusting the distance of the transfer device from the ends of the substantially horizontally extending endless conveyor, and the inclined endless conveyor being so arranged that the lower end subtends the front end of the substantially horizontally extending endless conveyor of the preceding box car and the higher end overlaps the rear end of the substantially horizontally extending endless conveyor of the succeeding box car.

This adjustability makes the transfer device useful for operation in opposite conveying directions while requiring little retrofitting so that the bulk material may be readily conveyed along the train in either direction. Such an adjustment requires only an operation of the adjusting drive to move a previously subtending end of the transfer device into a position in which it overlaps the end of the bottom conveyor arrangement while the overlapping end is moved into the subtending position. It is a particular advantage of this arrangement that the entire storage capacity of the storage box is fully available in both conveyor directions.

According to a preferred embodiment, a chassis is provided for carrying the bulk material transfer device, the transfer device carrying chassis having couplings for coupling this chassis to the preceding and succeeding box cars, the couplings being extensible in the longitudinal direction and comprising drive means for extending and retracting the couplings. This enables the transfer device to be temporarily repositioned to provide extra space for repositioning the subtending and overlapping ends without problems.

BRIEF DESCRIPTION OF THE DRAWING

The above and other objects, advantages and features of the invention will become more apparent from the following detailed description of certain now preferred embodiments thereof, taken in conjunction with the accompanying, somewhat schematic drawing wherein

FIG. 4 is a fragmentary enlarged top view of an extensible coupling between two adjoining box cars to enable the distance therebetween to be temporarily adjusted; and FIGS. 5 to 11 schematically illustrate various embodiments of the box car of the present invention.

DETAILED DESCRIPTION OF THE PREFERRED EMBODIMENTS

Figure 1:
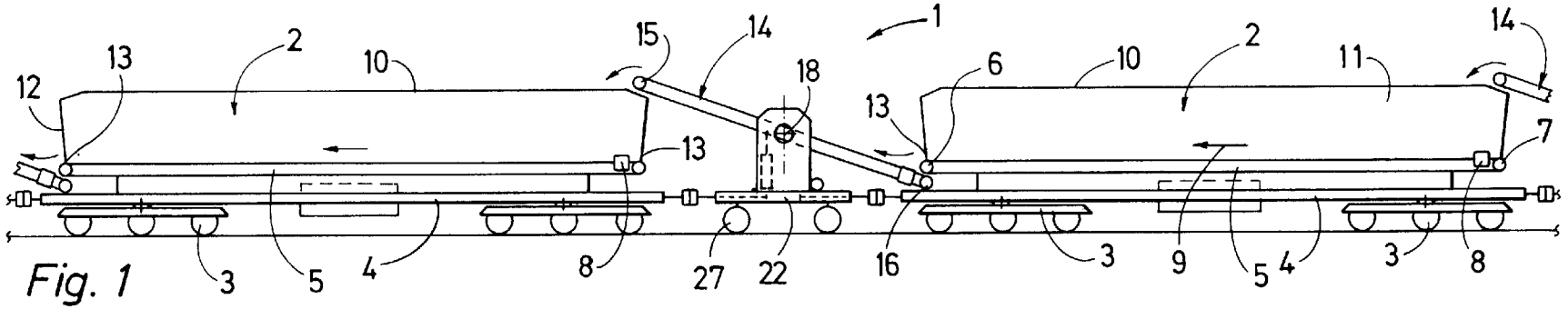
FIGS. 1, 2 and 3 are side elevational views showing two adjoining box cars of a freight train, with the inclined endless conveyor of the bulk material transfer device in different operating positions.

Like reference numerals designate like parts functioning in a like manner in all figures.

Figure 2:
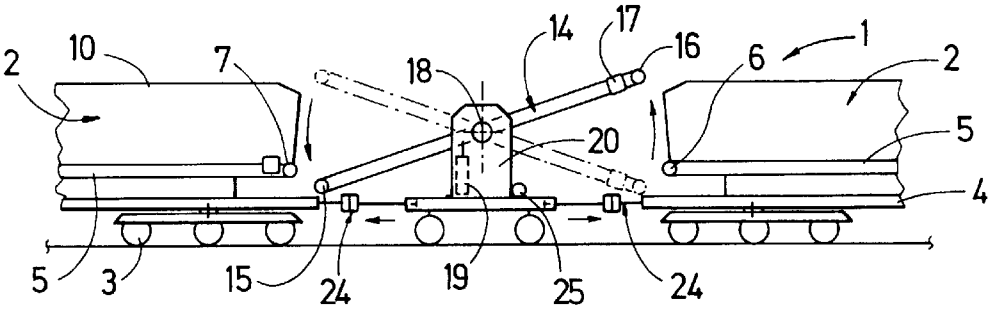
Figure 3:
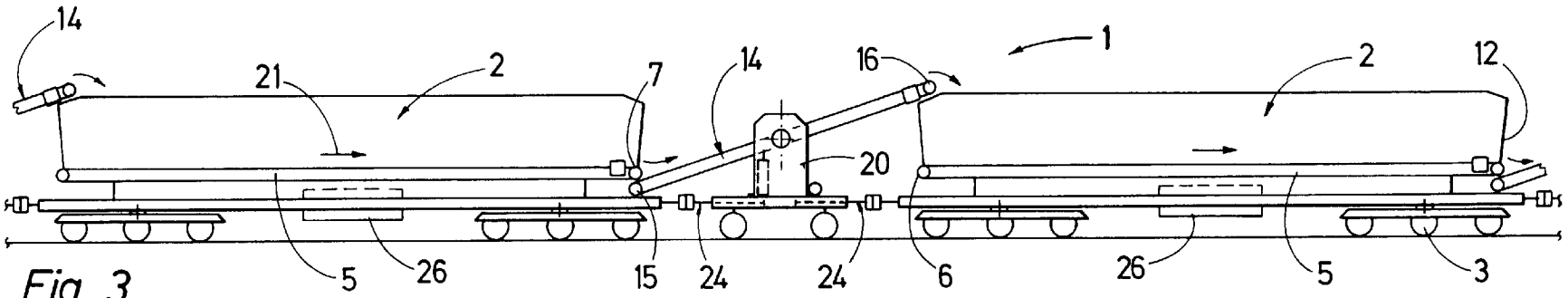

Referring first to FIGS. 1 to 3, there is shown a box car 2 for carrying bulk material and capable of being incorporated into freight train 1 of a plurality of successively arranged like box cars 2. Each box car comprises flat chassis 4 supported on undercarriages 3. Elongated box 10 for storing the bulk material extends in a longitudinal direction and is mounted on chassis 4, the box having an open top and a bottom region. Conveyor arrangement 5 extends in the longitudinal direction in the bottom region and is supported on chassis 4. The conveyor arrangement comprises a substantially horizontally extending endless conveyor band having two ends 6, 7 spaced from each other in the longitudinal direction and drive 8 for moving the endless conveyor in a conveying direction indicated by arrow 9, or in a conveying direction opposite thereto. One of the endless conveyor ends 7 is a rear end in the illustrated conveying direction and another one of the endless conveyor ends 6 is a front end in this conveying direction. Conveyor arrangement 5 forms the bottom of bulk material storage box 10 which is constituted by two parallel side walls 11 extending in the longitudinal direction and two end walls 12 extending perpendicularly thereto. The lower ends of the end walls are spaced from conveyor arrangement 5 to define discharge openings 13 therewith.

A bulk material transfer device 14 for transferring the bulk material from bottom conveyor arrangement 5 of a preceding box car 2 to the bottom conveyor arrangement of a succeeding box car, the preceding and succeeding box cars being coupled to each other, comprises inclined endless conveyor band 14 having a lower end 15 and an upper end 16, and drive 17 for moving the inclined endless conveyor band. As shown in FIG. 2, according to this invention, an adjusting drive 19 is provided for adjusting the distance of the transfer device from ends 6, 7 of the substantially horizontally extending endless conveyor, and inclined endless conveyor 14 is so arranged that lower end 16 subtends front end 6 of the substantially horizontally extending endless conveyor of the preceding box car and higher end 15 overlaps rear end 7 of the substantially horizontally extending endless conveyor of the succeeding box car. The inclined endless conveyor is pivotal by drive 19 about horizontal axis 18 extending perpendicularly to the longitudinal direction for adjusting the transfer device between the two described positions.

In the illustrated embodiment, a chassis 22 carries bulk material transfer device 14 and is supported on the track by undercarriages 27. The transfer device carrying chassis has couplings 24 for coupling chassis 22 to the preceding and succeeding box cars 2. The couplings are extensible in the longitudinal direction and comprise drives 23 for extending and retracting the couplings, as described more fully hereinafter in connection with FIG. 4.

In the embodiments shown in FIGS. 1 to 6, a carrier frame 20 is mounted on chassis 22, and the inclined endless conveyor is pivotally mounted on the carrier frame for pivoting by adjusting drive 19 about axis 18. Furthermore, carrier frame 20 is displaceable on chassis 22 perpendicularly to the conveyor direction by drive 25.

Alternatively, one end of chassis 22 could be linked to chassis 4 of an adjoining box car 2 while an opposite end of chassis 22 is supported on an undercarriage 27. Each box car 2 is equipped with motor 26 for supplying power, such as hydraulic fluid pressure, to drives 8, 17, 19 and 25.

In the operating position of bulk material transfer device 14 illustrated in FIG. 1, the bulk material is conveyed in the direction indicated by arrow 9 when drives 8 and 17 are actuated to move the endless conveyors in the conveying direction. By selectively changing the conveying speeds in succeeding box cars 2, the bulk material can be conveyed further or stored in respective ones of the box cars. By transversely displacing carrier frames 20 of the transfer devices by actuating drives 25, the transfer devices may be used in track curves without any difficulty.

If it is desired to reverse the conveying direction, as indicated by arrow 21 (FIG. 3), drives 23 are actuated to extend couplings 24 so that adjoining box cars 2 are further spaced apart (see FIG. 2). Subsequently, drives 19 are actuated to pivot the inclined endless conveyors about axes 18 until their previously higher ends 15 that overlapped rear end 7 of the succeeding box car become their lower ends to subtend what have become the front ends of the preceding box cars. At the same time, previously lower ends 16 that subtended front end 6 of the preceding box car become their higher ends to overlap what have become the rear ends of the succeeding box cars. Drives 23 are then again actuated to retract couplings 24 so that the adjoining box cars assume their normal distance, thus automatically positioning inclined endless conveyor ends 15, 16 in their respective subtending and overlapping relationships with ends 6, 7. Drives 8 and 17 are then actuated to drive the endless conveyors in the opposite direction indicated by arrow 21. If desired, the length-adjustable couplings between box cars 2 may be replaced with standard couplings allowing no adjustment, in which case the coupling between two adjoining box cars would have to be detached and the two box cars would have to be moved sufficiently apart to provide sufficient space for the pivoting inclined endless conveyor if the transfer device.

As shown in FIG. 4, extensible coupling 24 comprises coupling part 35 mounted in guide 36 on chassis 22 for displacement in the longitudinal direction. Drive 23 is connected to displaceable coupling part 35 to displace the same. In the retracted position of the extensible coupling used during normal operation of the freight train (shown in phantom lines), displaceable coupling part 35 is fixed in position relative to chassis 22 by blocking device 38. The blocking device comprises hydraulically displaceable bolt 40 which may be moved into, and out of, bore 39 in coupling part 35.

In the embodiment illustrated in FIGS. 5 and 6, the adjusting drive for transfer device 14 is drive 28 for pivoting carrier frame 20 on chassis 22 about axis 29 extending vertically to the chassis. When the conveying direction is reversed, carrier frame 20 with transfer device 14 is pivoted about axis 29 (as indicated by the arcuate arrow in FIG. 5) by 180° so that lower end 16 becomes the higher end and higher end 15 becomes the lower end of the transfer device, as shown in phantom lines, the subtending end becoming the overlapping end and the overlapping end becoming the subtending end relative to adjacent ends 6 and 7 of bottom conveyor arrangements 5.

In the embodiment shown in FIG. 7, bulk material transfer device 14 is pivotally mounted on support frame 30, and drives 33, 34 are arranged for pivoting the transfer device about horizontal axis 31 extending perpendicularly to the conveyor arrangement as well as vertical axis 32. The support frame projects from an end of box car chassis 4, and drive 37 is actuatable for pivoting support frame 30 on the box car chassis about vertical axis 52. In this embodiment, too, it is not absolutely necessary to make the distance between adjoining box cars adjustable for adjusting transfer device between the positions shown in full and phantom lines.

In the embodiment illustrated in FIGS. 8 to 11, coupling 41 for detachably attaching the ends of the inclined endless conveyor with the preceding and succeeding box cars 2, respectively, is arranged at each end of box car 2 between bottom conveyor arrangement 5 and chassis 4. As particularly shown in the top view of FIG. 11, coupling 41 comprises coupling carriage 43 at each end of substantially horizontally extending endless conveyor 14, the coupling carriages being slidably mounted on box car chassis 4 for displacement in the longitudinal direction by drive 42. Each coupling carriage is guided for displacement on guide tracks 44 connected to chassis 4. Coupling carriages 43 are mounted on guide plates 45 for rotation about vertical axis 46, the guide plates being guided along guide tracks 44 on chassis 4. Coupling carriage 43 has two attachment cylinders 47 transversely spaced from each other for detachably attaching the ends of inclined endless conveyor 14 to the coupling carriages. As shown, flanges 49 at the ends of the inclined endless conveyor are provided for detachable attachment of coupling carriages 43. Each attachment cylinder 47 is equipped with a hydraulically operable bolt 48 which may be moved into, and out of, a bore in flanges 49 for attaching and detaching the inclined endless conveyor.

Figure 8:
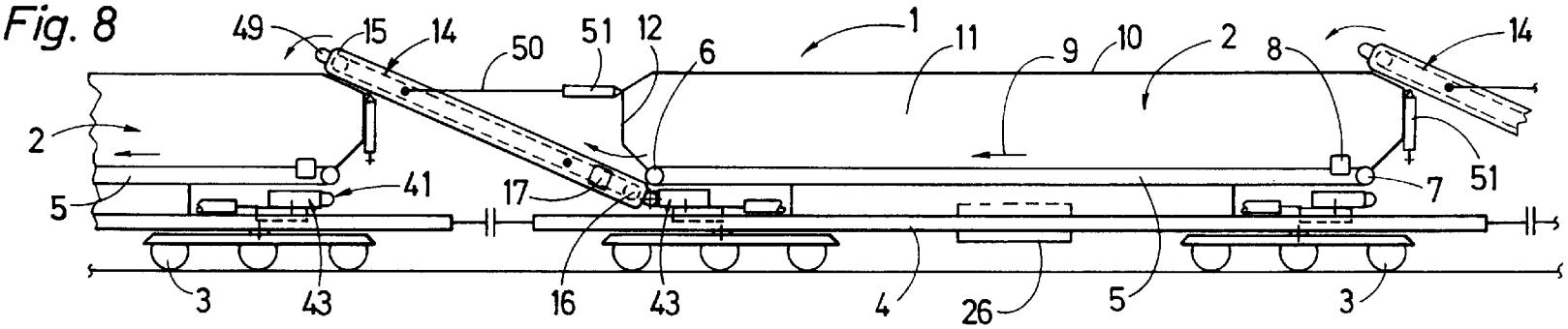

As shown in FIG. 8, lower end 16 of inclined endless conveyor 14 is attached to coupling carriage 43. In addition the inclined endless conveyor is held in the illustrated position by cable connection 50 and support jack 51. When conveying drives 8 and 17 are actuated, the bulk material is conveyed in the direction of arrow 9 from a preceding to a succeeding box car 2.

Figure 9:
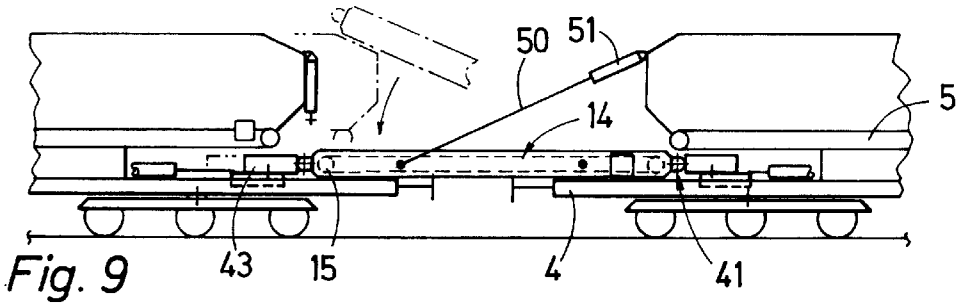
Figure 10:
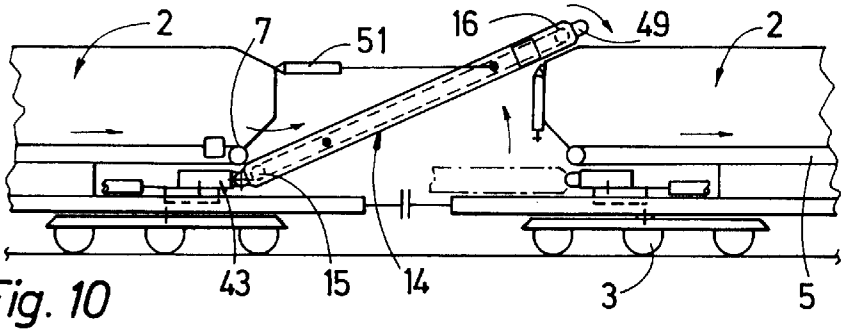
Figure 11:
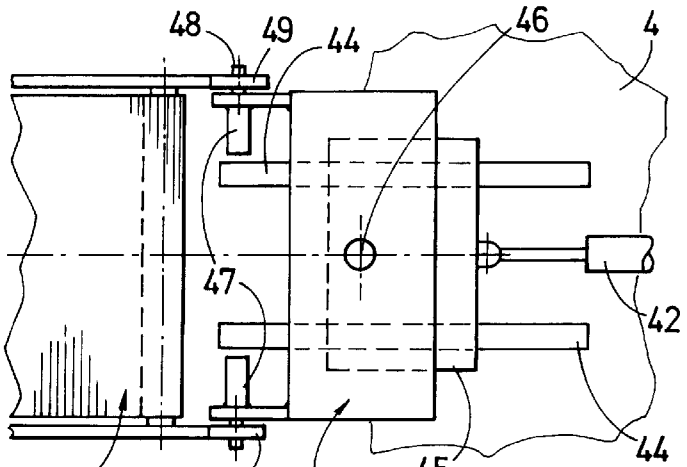

When the conveying direction is to be reversed, the adjoining box cars 2 are detached from each other, i.e. the coupling is released, so that the cars may be moved apart sufficiently to enable cable connection 51 to lower the transfer device into the horizontal position illustrated in FIG. 9. Subsequently, drive 42 for displacing coupling carriage 43 at the end opposite to end 15 is actuated to move the coupling carriage toward the opposite end, and the opposite end of transfer device 14 is attached to flange 49 at this opposite end. Thereupon, end 15 is detached from its coupling carriage, cable connection 51 is connected to transfer device 14 at the opposite end so that this opposite end is connected to the adjoining box car. As shown in FIG. 10, the coupling carriage at end 15 is now displaced until end 15 subtends end 7 of bottom conveying arrangement 5 and cable connection 51 is operated to lift transfer device 14 so that end 16 overlaps the rear end of the bottom conveyor arrangement of the succeeding box car. The adjoining box cars are then coupled together again, and the freight train is in condition for operation in the reverse conveying direction.

What is claimed is:

1. A box car for carrying bulk material and capable of being incorporated into a freight train of a plurality of successively arranged like box cars, the box car comprising (a) a chassis, (b) an elongated box for storing the bulk material, the elongated box extending in a longitudinal direction and being mounted on the chassis, and the box having an open top and a bottom region, and (c) a conveyor arrangement extending in the longitudinal direction in the bottom region, the conveyor arrangement comprising (1) a substantially horizontally extending endless conveyor having two ends spaced from each other in the longitudinal direction and (2) a drive for moving the endless conveyor in a conveying direction, one of the endless conveyor ends being a rear end in the conveying direction and another one of the endless conveyor ends being a front end in the conveying direction, and (d) a bulk material transfer device for transferring the bulk material from a preceding one of two successive ones of said box cars to a succeeding one of said box cars, the preceding and succeeding box cars being coupled to each other, the bulk material transfer device comprising (1) an inclined endless conveyor having a lower end and an upper end, (2) a drive for moving the inclined endless conveyor, and (3) an adjusting drive for adjusting the distance of the transfer device from the ends of the substantially horizontally extending endless conveyor, and the inclined endless conveyor being so arranged that the lower end subtends the front end of the substantially horizontally extending endless conveyor of the preceding box car, and the higher end overlaps the rear end of the substantially horizontally extending endless conveyor of the succeeding box car.

2. The box car of claim 1, further comprising a chassis carrying the bulk material transfer device.

3. The box car of claim 2, wherein the transfer device carrying chassis has couplings for coupling said chassis to the preceding and succeeding box cars, the couplings being extensible in the longitudinal direction and comprising drive means for extending and retracting the couplings.

4. The box car of claim 2, further comprising a carrier frame mounted on the chassis, and the inclined endless conveyor being pivotally mounted on the carrier frame for pivoting by the adjusting drive about a horizontal axis extending perpendicularly to the longitudinal direction.

5. The box car of claim 2, further comprising a carrier frame mounted on the chassis, and wherein the adjusting drive is a drive for pivoting the carrier frame on the chassis about an axis extending vertically to the chassis.

6. The box car of claim 2, further comprising a drive for displacing the carrier frame on the chassis perpendicularly to the conveying direction.

7. The box car of claim 1, further comprising a support frame projecting from an end of the box car chassis, the bulk material transfer device being pivotally mounted on the support frame for pivoting about a horizontal axis extending perpendicularly to the conveyor arrangement as well as a vertical axis.

8. The box car of claim 7, further comprising a drive for pivoting the support frame on the box car chassis about a vertical axis.

9. The box car of claim 1, further comprising coupling means for detachably attaching the ends of the inclined endless conveyor with the preceding and succeeding box cars.

10. The box car of claim 9, wherein the coupling means comprises a coupling carriage at each end of the substantially horizontally extending endless conveyor, the coupling carriages being slidably mounted on the box car chassis for displacement in the longitudinal direction, and an attachment cylinder for detachably attaching the ends of the inclined endless conveyor to the coupling carriages.

11. The box car of claim 10, further comprising a flange at the ends of the inclined endless conveyor for detachable attachment of the coupling carriages.

12. The box car of claim 10, wherein the coupling carriages are mounted on the box car chassis for rotation about a vertical axis.

* * * * *